United States Patent [19]

Wall

[11] Patent Number: 4,722,270

[45] Date of Patent: Feb. 2, 1988

[54] SELF-COMPACTING REFUSE CONTAINER

[76] Inventor: John H. Wall, 11043 - 146A Street, Surrey, British Columbia, Canada

[21] Appl. No.: 909,893

[22] Filed: Sep. 22, 1986

[51] Int. Cl.[4] ..... B30B 1/34; B30B 15/06

[52] U.S. Cl. ..... 100/233; 100/269 R; 100/295; 220/1 T; 414/411; 292/263

[58] Field of Search ..... 100/229 A, 233, 219, 100/269 R, 273, 295; 220/1 T, 334; 414/411; 292/263

[56] References Cited

U.S. PATENT DOCUMENTS

| | | | |
|---|---|---|---|
| 2,616,312 | 11/1952 | Jones et al. | 100/233 X |
| 3,826,187 | 7/1974 | Smolka | 100/233 X |
| 3,961,573 | 6/1976 | Schmidt | 100/233 X |
| 4,235,165 | 11/1980 | Fenner et al. | 100/233 X |
| 4,271,756 | 6/1981 | Bettencourt | 100/233 X |
| 4,424,740 | 1/1984 | Guathney et al. | 100/233 X |

*Primary Examiner*—Andrew M. Falik

*Attorney, Agent, or Firm*—Carver & Co.

[57] ABSTRACT

A self-compacting refuse container has a receptacle for refuse, having a top opening. There is a lid adjacent the opening sized to slidably fit within the opening. A hinge connects the lid to the receptacle and permits hinged movement of the lid into the opening or out of the opening. There is a power source for forcibly moving the lid about the hinge into the top opening to compact refuse within the receptacle. Preferably, the container has a release mechanism for releasing the power source to permit hinged movement of the lid away from the opening for emptying refuse from the receptacle.

23 Claims, 6 Drawing Figures

SELF-COMPACTING REFUSE CONTAINER

BACKGROUND OF THE INVENTION

Refuse containers having built-in compacters are known, including some which are adapted to be engaged by a forklift device for dumping purposes. One earlier example is found in U.S. Pat. No. 3,961,573 to Schmidt. This patent discloses a refuse bin with a compacter blade which is connected to the cover by a hinge. However the compacter blade does not form the cover itself. The compacter blade is raised together with the lid by disengaging a latch to gain access to the inside of the container.

U.S. Pat. No. 3,680,478 to Beachner shows a refuse container having pivotal latch hooks 57 which are manually engageable for releasing the lid section during the dumping process. Other devices of the general type are found in U.S. Pat. Nos. 4,290,352 to Schmidt, 3,709,389 to Steltz and 4,070,962 to Peterson.

SUMMARY OF THE INVENTION

A self-compacting refuse container comprises a receptacle for refuse, having an opening. There is lid means adjacent the opening sized to slidably fit within the opening. Hinge means connects the lid means to the receptacle and permits hinged movement of the lid means into the opening or out of the opening. A power source is provided for forcibly moving the lid means about the hinge means into the top opening to compact refuse within the receptacle.

Preferably, the container has release means for releasing the power source means to permit hinged movement of the lid means away from the opening for emptying refuse from the receptacle. The power source means may comprise a fluid powered cylinder having a first end pivotally connected to the lid means and a second end pivotally connected to the receptacle. In this case, the release means may comprise a pivotally mounted arm, one end of the cylinder being pivotally connected to the arm, and means for releasably holding the arm in a first position for compacting the refuse.

In one embodiment, the means for releasably holding comprises a lever pivotally mounted on the receptacle having a detent for releasably holding the arm in said first position when the lever is in a first position. The lever is pivotable towards a second position whereas a detent releases the arm, permitting the arm to pivot about the receptacle so the lid means can be hingedly moved away from the opening.

In a second embodiment, the means for releasably holding comprises a turnbuckle selectively engageable with the arm.

The self-compacting refuse container may also include means for holding compacted refuse within the receptacle when the lid means moves away from the opening. The means for holding compacted refuse comprises at least one member hingedly connected to the receptacle adjacent the opening and being movable to a position inside the receptacle to compact the refuse.

DESCRIPTION OF THE PREFERRED EMBODIMENT

Figure 1:
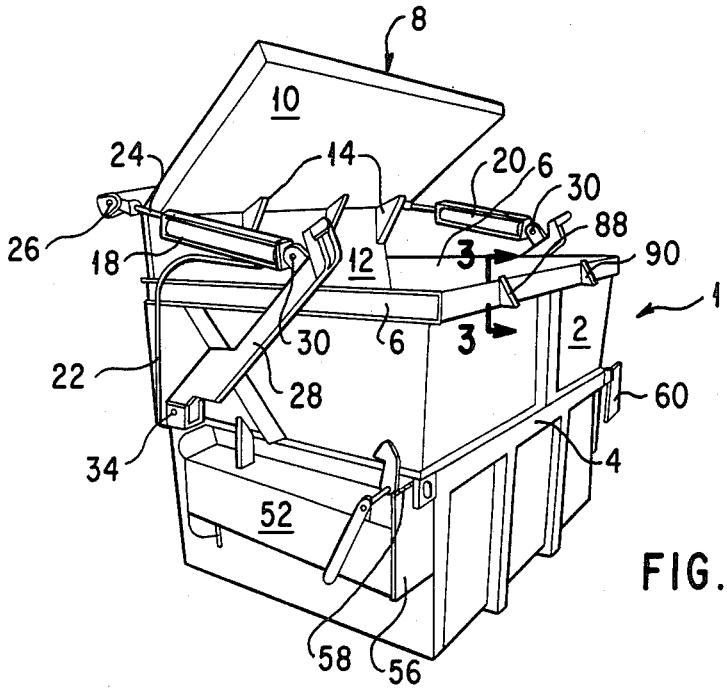
FIG. 1 is a perspective view of a self-compacting refuse container according to a first embodiment of the invention.

Referring to the drawings, FIG. 1 is a perspective view of a self-compacting refuse container 1. Container 1 has a receptacle 2 preferably made of steel plate and strengthened in the conventional manner using boxsectioned members 4, channels or the like. The receptacle in this embodiment is box-shaped having a rectangular top opening 6.

Figure 4:
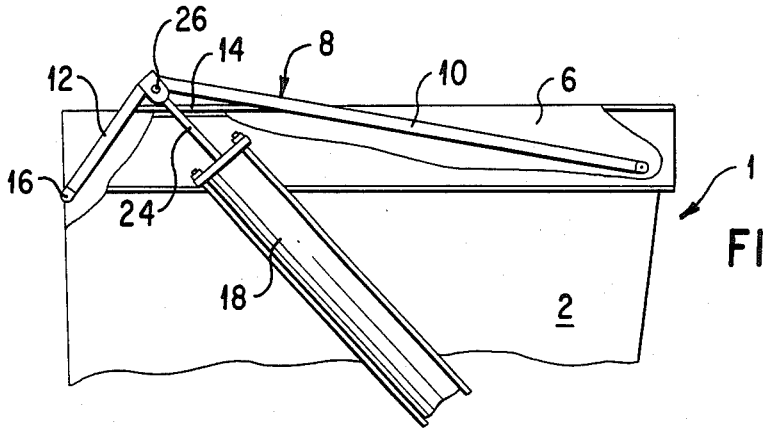
FIG. 4 is an enlarged side elevation of the self-compacting refuse container of FIG. 1 showing the lid in a position within the container for compacting refuse.

There is a lid 8 adjacent the opening 6 sized to slidably fit within the opening as shown in FIG. 4. The lid is preferably of steel plate, having a rectangular front portion 10 and a smaller rectangular back portion 12. The back portion and front portion are connected to each other at an angle so that the front portion is inclined downwardly when the lid is closed as shown in FIG. 4. Gussets 14 are used to strengthen the connection between portions 10 and 12. The lid is connected to the receptacle by a hinge 16 spaced a short distance downwardly from the top of the receptacle. The hinge permits hinged movement of the lid into the opening as seen in FIG. 4 or out of the opening as seen in FIG. 1.

Container 1 has a power source including hydraulic cylinders 18 and 20, on opposite sides thereof, for forcibly moving the lid about hinge 16 into the top opening 6 to compact refuse within the receptacle. Cylinders 18 and 20 are conventional and are connected to a conventional portable hydraulic fluid pump by means of hydraulic fluid lines 22. Each of the cylinders is pivotally connected to the lid at one end and pivotally connected to the receptacle at the other end. For example, rod 24 of cylinder 18 is connected to the lid by a pivotal connection 26. The bottom of the cylinder is connected to arm 28 of the receptacle by means of a pivotal connection 30. Cylinder 20 has the same connections which are numbered the same.

Arm 28, and an identical arm 32 on the opposite side of the container, are part of a release mechanism for releasing cylinders 18 and 20 to permit hinged movement of the lid away from the opening as seen in FIG. 1, for emptying refuse from the receptacle. Each of the arms 28 and 32 is pivotally connected to the receptacle, for example employing pivotal connection 34 for arm 28.

The release mechanism also includes a mechanism for releasably holding each of the arms in a first position for compacting refuse. This is the horizontal position of each arm as illustrated for arm 32 in FIG. 2. In this embodiment, the mechanism for releasably holding the arm includes a lever 36 pivotally mounted on the receptacle by pivotal connection 38 including journals 40 and an axle 42. The lever has a detent 44 capable of engaging a bar 46 of arm 32. The bar is connected between uprights 48 and 50 on the end of the arm which is opposite the end pivotally connected to the receptacle.

Figure 2:
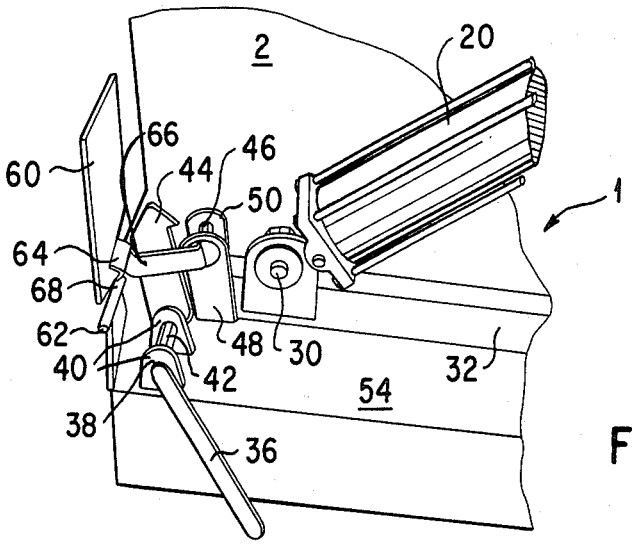
FIG. 2 is a fragmentary perspective view of the opposite side of the container of FIG. 1 showing the bottom of the cylinder and the release mechanism.

Referring to FIG. 2, detent 44 is moved slightly out of engagement with bar 46 for illustrative purposes. In actual practice, the lever has a first position rotated slightly clockwise from the position of FIG. 2 where the detent engages bar 46 to hold the arm in the position for compacting refuse in the container. The detent is rotated counter-clockwise, using lever 36, to release the arm, permitting the arm to pivot about its opposite end so the lid can be hingedly raised as shown in FIG. 1. This second position is more counter-clockwise than the position shown in FIG. 4.

Refuse containers of this type are emptied by inverting the container over a large truck using front mounted forks on the truck. For this purpose, a rectangular tube 52 is connected to one side of the receptacle and a similar rectangular tube 54 is connected on the opposite side. It is desirable to prevent insertion of the forks when detent 44 engages bar 46 on each side of the container. In this position, the lid will not drop when the container is inverted. For this purpose, a flap 56 is connected to the front of tube 52 by a hinge 58. A similar flap 60 is connected to the front of tube 54 by a hinge 62. When a truck arrives to empty the container, each of the flaps is raised as shown for flap 60 in FIG. 2. This permits insertion of the forks of the truck into the tubes.

Each of the flaps has a latch member 64, shown in FIG. 2, consisting of a short length of angle section welded to the back of the flap in this embodiment. The latch member provides means for holding lever 36 and detent 44 in the second position mentioned above. This is a position slightly counter-clockwise from the position of FIG. 2. It may be appreciated that detent 44 may be rotated counter-clockwise past the position shown and flap 60 an then be raised so latch 64 engages the top of the detent and prevents lever 36 and detent 44 from returning to the position where the detent engages bar 46.

A trip member 66 is located on each of the arms. FIG. 2 illustrates trip member 66 extending from upright 48 on arm 32. It may be observed that the curved front end 68 of the trip member contacts latch member 64 of the flap as arm 32 pivots upwardly from the position of FIG. 2. This disengages the latch member from detent 44.

Figure 6:
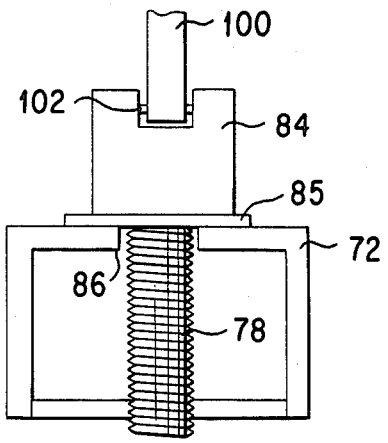
FIG. 6 is an enlarged front elevation of the turnbuckle and arm for the release mechanism of FIG. 5.
Figure 5:
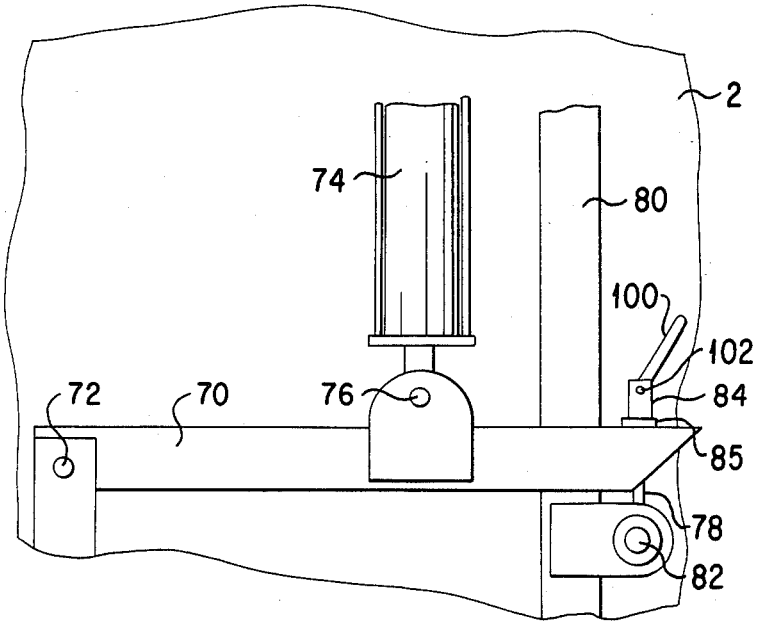
FIG. 5 is an enlarged fragmentary side elevation of an alternative release mechanism for the self-compacting refuse container of FIG. 1.

FIG. 5 illustrates an alternative release mechanism which also includes an arm 70 connected to receptacle 2 by a pivotal connection 72. An hydraulic cylinder 74 extends to the lid and is connected to the arm by a pivotal connection 76. An eye-bolt 78 is connected to an upright member 80 on the receptacle by means of a pivotal connection 82. The eye-bolt has a tightener 84 located on top of a slot 86 on the end of lever 70 opposite pivotal connection 72. A washer 85 is disposed between the tightener 84 and the arm 70. This slot is shown in FIG. 6. The tightener has a threaded portion therein for receiving the top of the eye-bolt. A handle 100 is hingedly conected to the tightener by a pin 102.

In this embodiment, the arm is released by loosening the tightener 84 on the eye-bolt by turning handle 100 counter-clockwise and pivoting the eye-bolt about pivotal connection 82 so the tightener is disengaged from slot 86.

Figure 3:
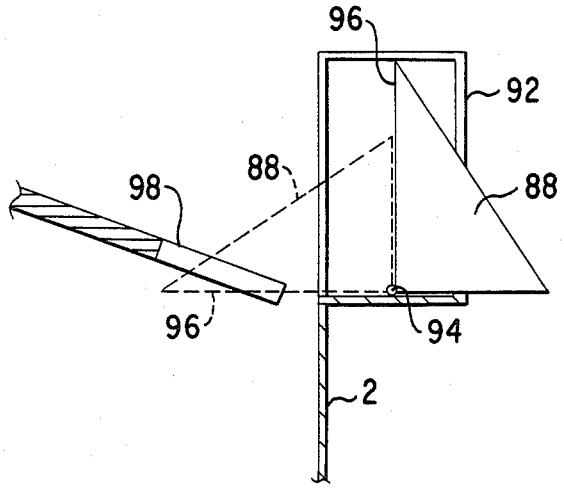
FIG. 3 is an enlarged sectional view taken along line 3—3 of FIG. 1.

Members 88 and 90 adjacent the opening 6 of the receptacle provide means for holding compacted refuse within the receptacle when the lid moves away from the opening. For illustrative purposes, the members 88 and 90 are shown projecting forward in FIG. 1 and in solid lines in this position in FIG. 3. However, the normal positon is that illustrated in broken lines for member 88 in FIG. 3. Each of the members is located in a slot 92 in the receptacle and is connected to the receptacle by a spring-biased hinge 94. Each of the members is rectangular in shape, having a flat side 96 which contacts the refuse to hold the refuse in the compacted position within the receptacle. Slots 98 in lid 8, showns only in FIG. 3, provide clearance for the members when they are in the normal position shown in broken lines.

OPERATION

In normal use, the arms 28 and 32 remain in the horizontal position as illustrated for arm 32 in FIG. 2. The detents 44 of levers 36 on each side of the receptacle are rotated slightly clock-wise from the position of Figure 2 to engage the bars 46 on the ends of each of the arms. Hydraulic lines 22 on each of the cylinders 18 and 20 are connected to a portable hydraulic pump. The lid 8 is raised using the cylinders in order to add refuse to the container.

When the receptacle is full, the refuse ought to be compacted so that additional refuse can be added to the container before it must be emptied. This is accomplished by retracting cylinders 18 and 20 to move the lid downwardly into the container as shown in FIG. 4. The lid thus acts as a blade for compacting refuse within the container. When the refuse is compacted, the cylinders are again used to raise the lid so more refuse can be added.

With reference to the embodiments of FIGS. 1 and 2, the next mode of operation occurs when the container is full of compacted refuse. A truck arrives on the site and is presented with a container having a closed lid and with flaps 56 and 60 closed. Thus the forks of the truck do not have access to the interior of tubes 52 and 54. An operator then rotates lever 36 on each side of the receptacle until detent 44 is in the second position further in the counter-clockwise direction than illustrated in FIG. 2. Each of the flaps 56 and 60 is raised until the latch member 64 engages the detent 44. The forks of the truck are then inserted in the tubes 52 and 54.

In the conventional manner, the container is raised over the truck until it is inverted over the open back of the truck. In the process, the weight of lid 8 swings arm 28 about pivot 34 and swings arm 32 in a similar manner. As the arms begin to pivot, the trip member 66 in each case engages latch members 64 of flaps 56 and 60, thus releasing detent 44 on each side of the receptacle.

The compacted refuse is normally held in the receptacle by members 88 and 90. However, the weight of the refuse in the inverted receptacle causes the members to rotate to the position shown in FIG. 1 and in solid lines in FIG. 3. This permits the refuse in the container to empty when the container is sufficiently inverted. Once this occurs, the truck places the container back on the ground using the forks.

As the container returns to the ground, flaps 56 and 60 are pivoted towards their closed position and return to this position once the forks of the truck are removed. The weight of each of the levers 36 causes detents 44 on each side of the receptacle to engage bar 46 of each of the arms 28 and 32. If desired, levers 36 may be spring-biased to assure their return to this position. The container is thus returned to its orginal position for normal operation.

The embodiment of FIG. 5 is similar, but simplified. In this case, the operation is manual. When the truck arrives, the tightener 84 on each side of the receptacle is slackened off by employing the handle in the manner described above, and the eye-bolt 78 is pulled outwardly to release arm 70 on each side of the receptacle. The container is dumped in the same manner as the previous embodiment. Afterwards, eye-bolt 78 is manually rotated upwardly and tightener 84 is retightened using the handle.

What is claimed is:

1. A self-compacting refuse container comprising:

a receptacle for refuse, having a top opening;

lid means adjacent the opening sized to fit within the opening;

hinge means connecting the lid means to the receptacle and for permitting hinged movement of the lid means into the opening or out of the opening; and means for forcibly moving the lid means about the hinge means into the top opening to compact refuse within the receptacle, the means for forcibly moving being connected to the receptacle and to the lid means.

2. A container as claimed in claim 1, further comprising release means for releasing the means for forcibly moving from the release means to permit free hinged movement of the lid means away from the opening for emptying refuse from the receptacle.

3. A container as claimed in claim 2, wherein the means for forcibly moving comprises a fluid powered cylinder having a first end pivotally connected to the lid means and a second end pivotally connected to the receptacle.

4. A container as claimed in claim 3, wherein the release means comprises a pivotally mounted arm, one said end of the cylinder being pivotally connected to the arm, and means for releasably holding the arm in a first position whereby the lid means can compact the refuse.

5. A container as claimed in claim 3, wherein there is one said cylinder on one side of the receptacle and another said cylinder on a side of the receptacle opposite the one said cylinder, each said cylinder having a corresponding said release means.

6. A container as claimed in claim 4, wherein the arm is pivotally connected to the receptacle.

7. A container as claimed in claim 4, wherein the means for releasably holding comprises a bolt selectively engageable with the arm.

8. A container as claimed in claim 7, wherein the arm has a slot therein for receiving the bolt.

9. A container as claimed in claim 6, wherein the means for releasably holding comprises a lever pivotally mounted on the receptacle and having a detent for releasably holding the arm in said first position when the lever is in a first position, the lever being pivotable towards a second position where the detent releases the arm, permitting the arm to pivot about the receptacle so the lid means can be hingedly moved away from the opening.

10. A container as claimed in claim 9, comprising tubing means on the receptacle for receiving forks of a vehicle capable of inverting the container, whereby, when the lever is in the second position, the weight of the inverted lid means moves the lid means away from the opening for emptying refuse.

11. A container as claimed in claim 10, further comprising flap means on the tubing means for blocking the tubing means when the lever is in a first position.

12. A container as claimed in claim 11, wherein the flap means is hingedly connected to the receptacle adjacent the lever and is hingedly movable to an open position where the tubing means is clear to receive the forks of the vehicle, the flap means having a latch member thereon for engaging the lever when the lever is in the second position for holding the lever in the second position.

13. A container as claimed in claim 12, wherein the arm has a trip member for contacting the latch member of the flap means when the arm moves away from the first position of the arm to disengage the latch member from the lever.

14. A self-compacting refuse container, comprising:

a receptacle for refuse, having a top opening;

lid means adjacent the opening sized to fit within the opening;

hinge means for connecting the lid means to the receptacle and for permitting hinged movement of the lid means into the opening or out of the opening;

means for forceably moving the lid means about the hinged means into the top opening to compact refuse within the receptacle, wherein the means for forceably moving comprises a fluid powered cylinder having a first end pivotally connected to the lid means and a second end pivotally connected to the receptacle; and release means for releasing the means for forceably moving, to permit free hinged movement of the lid means away from the opening, for emptying refuse from the receptacle, the release means comprising a pivotally mounted arm, one said end of the cylinder being pivotally connected to the arm, and means for releasably holding the arm in a first position whereby the lid means can compact the refuse.

15. A container as claimed in claim 14, wherein the arm is pivotally connected to the receptacle.

16. A container as claimed in claim 15, wherein the means for releasably holding comprises a lever pivotally mounted on the receptacle and having a detent for releaseably holding the arm in said first position when the lever is in a first position, the lever being pivotable towards a second position where the detent releases the arm, permitting the arm to pivot about the receptacle so the lid means can be hingedly moved away from the opening.

17. A container as claimed in claim 16, comprising tubing means on the receptacle for receiving forks of a vehicle capable of inverting the container, whereby, when the lever is in the second position, the weight of the inverted lid means moves the lid means away from the opening for emptying refuse.

18. A container as claimed in claim 17, further comprising flap means on the tubing means for blocking the tubing means when the lever is in the first position.

19. A container as claimed in claim 18, wherein the flap means is hingedly connected to the receptacle adjacent the lever and is hingedly movable to an open position where the tubing means is clear to receive the forks of the vehicle, the flap means having a latch member thereon for engaging the lever when the lever is in the second position for holding the lever in the second position.

20. A container as claimed in claim 19, wherein the arm has a trip member for contacting the latch member of the flap means when the arm moves away from the first position of the arm to disengage the latch member from the lever.

21. A container as claimed in claim 14, wherein the means for releasably holding comprises a bolt selectively engagable with the arm.

22. A container as claimed in claim 21, wherein the arm has a slot therein for receiving the bolt.

23. A container as claimed in claim 14, wherein there is one said cylinder on one side of the receptacle and another said cylinder on a side of the receptacle opposite the one said cylinder, each said cylinder having a corresponding said release means.

* * * * *